US005833769A

United States Patent [19]

Kogiku et al.

[11] Patent Number: 5,833,769

[45] Date of Patent: Nov. 10, 1998

[54] WIDE IRON-BASED AMORPHOUS ALLOY THIN STRIP, AND METHOD OF MAKING THE SAME

[75] Inventors: Fumio Kogiku; Seiji Okabe; Kensuke Matsuki; Masao Yukumoto, all of Chiba, Japan

[73] Assignee: Kawasaki Steel Corporation, Japan

[21] Appl. No.: 726,950

[22] Filed: Oct. 7, 1996

[30] Foreign Application Priority Data

Oct. 9, 1995 [JP] Japan ..... 7-261485

[51] Int. Cl.[6] ..... H01F 1/153

[52] U.S. Cl. ..... 148/304; 420/121; 420/117; 164/463

[58] Field of Search ..... 148/304, 403; 420/121, 117; 164/463

[56] References Cited

U.S. PATENT DOCUMENTS

| | | | |
|---|---|---|---|
| 4,229,231 | 10/1980 | Witt et al. | 148/403 |
| 4,637,843 | 1/1987 | Takayama et al. | 420/74 |
| 4,834,815 | 5/1989 | Liebermann | 148/304 |
| 4,865,664 | 9/1989 | Sato et al. | 148/403 |
| 4,906,306 | 3/1990 | Araki et al. | 148/561 |
| 5,522,947 | 6/1996 | Kogiku et al. | 148/304 |
| 5,658,397 | 8/1997 | Kogiku et al. | 148/304 |

*Primary Examiner*—John Sheehan
*Attorney, Agent, or Firm*—Austin R. Miller

[57] ABSTRACT

A wide amorphous alloy thin strip having a width of 70 mm or above and useful as an iron core of electric power transformers, composed of Fe—Si—B—C amorphous alloy. Dispersion of an amorphous structure in the width direction is prevented and deterioration of the strip properties is suppressed by adding Mn or by casting in an atmosphere containing a carbonic acid gas in an amount of about 40 vol % or more to thereby control strip surface roughness to a center line average surface roughness of about 0.7 $\mu$m or less.

10 Claims, 5 Drawing Sheets

WIDE IRON-BASED AMORPHOUS ALLOY THIN STRIP, AND METHOD OF MAKING THE SAME

BACKGROUND OF THE INVENTION

1. Field of the Invention

The present invention relates to wide amorphous alloy thin strip capable of being used as an iron core of electric power transformers, and further relates to a method of making such wide, thin strip. The invention simultaneously provides stable widening characteristics and improved magnetic properties in a thin alloy strip. In the context of this invention the word "wide" means a strip having a dimension of at least 70 mm in the width direction. Typical "thin" sheet or strip has a thickness of about 22–28 $\mu$m.

2. Description of the Related Art

When molten metal primarily composed of Fe—B—Si is rapidly cooled and solidified at a cooling speed of about $10^{5°}$–$10^{6°}$ C./sec using a single roll method or the like, an amorphous alloy thin strip having a sheet thickness of several tens of microns can be obtained. Here, the term "amorphous" refers to a disordered atomic arrangement. A steel having a content of Fe:78 at % (hereinafter, simply shown by %), B: 13%, Si: 9% is representative of an amorphous alloy. The abbreviation "at" is intended to refer to the atomic percentage of the ingredient of the strip.

Since the amorphous alloy thin strip possesses excellent magnetic properties such as iron loss, flux density and the like, such strip is often used as an iron core of a transformer.

Various compositional changes have been proposed to improve the characteristics of the Fe—B—Si amorphous alloys. For example, Japanese Unexamined Patent Publication No. 57-137451, Japanese Unexamined Patent Publication No. 61-558, Japanese Unexamined Patent Publication No. 57-116750, Japanese Unexamined Patent Publication No. 54-148122 and Japanese Unexamined Patent Publication No. 5-503962 teach that amorphous alloy thin strip having excellent magnetic properties can be obtained through various combinations of the components Fe, B and Si.

Further, Japanese Unexamined Patent Publication No. 58-42751, Japanese Unexamined Patent Publication No. 55-158251 and Japanese Patent Publication No. 60-34620 teach that improvement in flux density is achieved by the addition of a specific amount of C to Fe—B—Si alloys.

Japanese Unexamined Patent Publication No. 61-136660 discloses a method of improving the properties of an insulating film while lowering material cost by reducing the amount of B needed through the addition of Mn to Fe—B—Si without deteriorating the flux density and iron loss, although it does not purport to improve the magnetic properties.

However, these prior art teachings are directed only to narrow thin strip having a width of about 20 mm. Further, each of the above-described references utilize different manufacturing conditions. Since the magnetic properties of thin strip are strongly affected by the manufacturing conditions that are used, even if thin strips are composed of the same components, they may have different magnetic properties when they are formed under different manufacturing conditions.

In particular, when, in laboratory scale, "wide" thin strip having a width of about 70 mm or above for use in electric power distribution transformers, was cast for an extended time using the same components and the same conditions typical of narrow thin strip cast, the magnetic properties of the wide thin strip were surprisingly found to be inferior to those of narrow thin strip.

As described above, since the prior art discloses and tests only narrow thin strip made on a laboratory scale, the components and manufacturing conditions needed to improve magnetic properties of wide thin strip have not been considered.

The present invention reflects discoveries made in regard to the production of wide amorphous alloy thin strip having a practically applicable sheet width of about 70 mm or more and suited for use as the iron core of electric power transformers, the thin strip being composed of C in addition to Fe—Si—B by which high flux density and excellent magnetic properties can realized by casting in the presence of a carbonic acid gas such as $CO_2$ at an average surface roughness of about 0.7 $\mu$m or less on the strip surface which contacts the roll. The invention further reflects discoveries wherein the strip contains Mn in addition to Fe, B, Si and C, with great effect.

BRIEF DESCRIPTION OF THE INVENTION

The present invention comprises a wide iron-based amorphous alloy thin strip having a width of about 70 mm or above and includes the components $Fe_aB_bSi_cC_d$ and optionally $Mn_e$, in the following approximate atomic proportions: where $78 \leqq a \leqq 81$ at %

$9 \leqq b \leqq 13$ at %

$6 \leqq c \leqq 12$ at %

$0.2 \leqq d \leqq 1.0$ at %

$0.2 \leqq e \leqq 1.0$ at %

The present invention may also comprise a wide iron-based amorphous alloy thin strip having a width of about 70 mm, which includes the components in the chemical formula of $Fe_aB_bSi_cC_d$, in the following approximate proportions:

where $78 \leqq a \leqq 81$ at %

$9 \leqq b \leqq 13$ at %

$6 \leqq c \leqq 12$ at %

$0.4 \leqq d \leqq 1.0$ at %;

wherein the thin strip is cast by rapid cooling and solidifying in an atmosphere containing at least about 40 vol % of a carbonic acid gas such as carbon dioxide, and has an average surface roughness Ra of about 0.7 $\mu$m or less on the strip surface which contacts the roll.

The invention further relates to a method of making such wide, thin strip.

DESCRIPTION OF THE PREFERRED EMBODIMENTS

Figure 1:
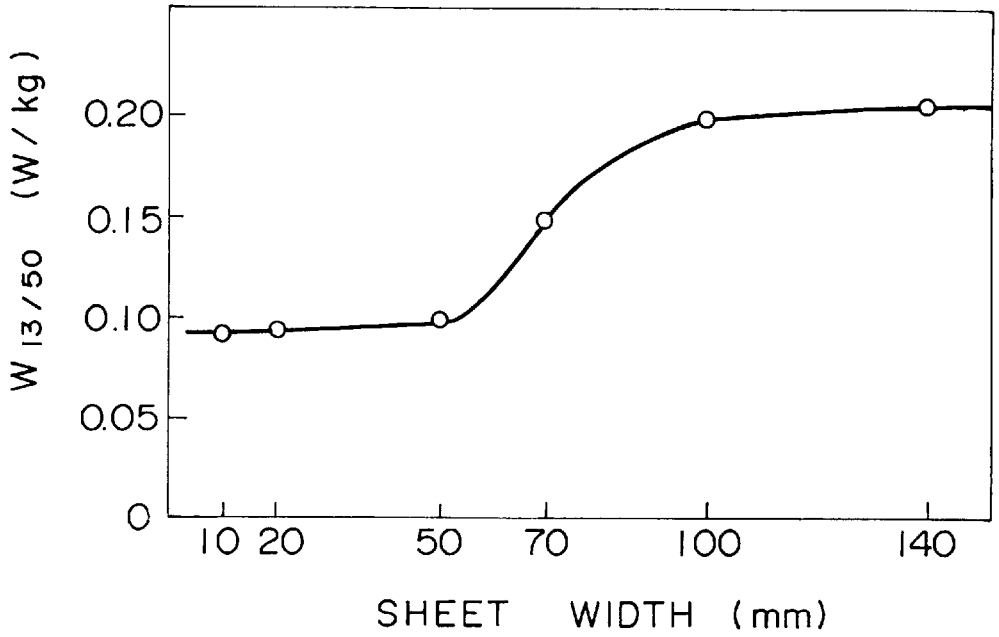
FIG. 1 is a graph showing the effect of the cast width of a thin strip on its magnetic properties.

We have discovered remarkable phenomena encountered by varying the cast width of a thin strip, and how these phenomena affect its magnetic properties. In making this discovery thin strip composed of $Fe_{79}B_{12}Si_{8.5}C_{0.5}$ and having widths in the range of 10–140 mm were cast by use of the single roll method. The width of each thin strip was changed by changing the width of the casting nozzle. The peripheral speed of the cooling roll was set to 24–30 m/sec. and the thin strip was cast in an ambient atmosphere. The thus obtained thin strip had sheet thicknesses of 22–28 $\mu$m. The resulting thin strips were subjected to a magnetic field of 20 Oe in the lengthwise direction and heat treated in an atmosphere of Ar at 350°–400° C. The magnetic properties of the resulting thin strips were measured over the entire width of the strip by a single sheet tester. The temperature at which the measurements were taken was 90° C. FIG. 1 of the drawings shows the result of the measurements, from which it was found that the iron loss values $W_{13/50}$ abruptly deteriorated when the sheet width exceeded about 50 mm.

Figure 2:
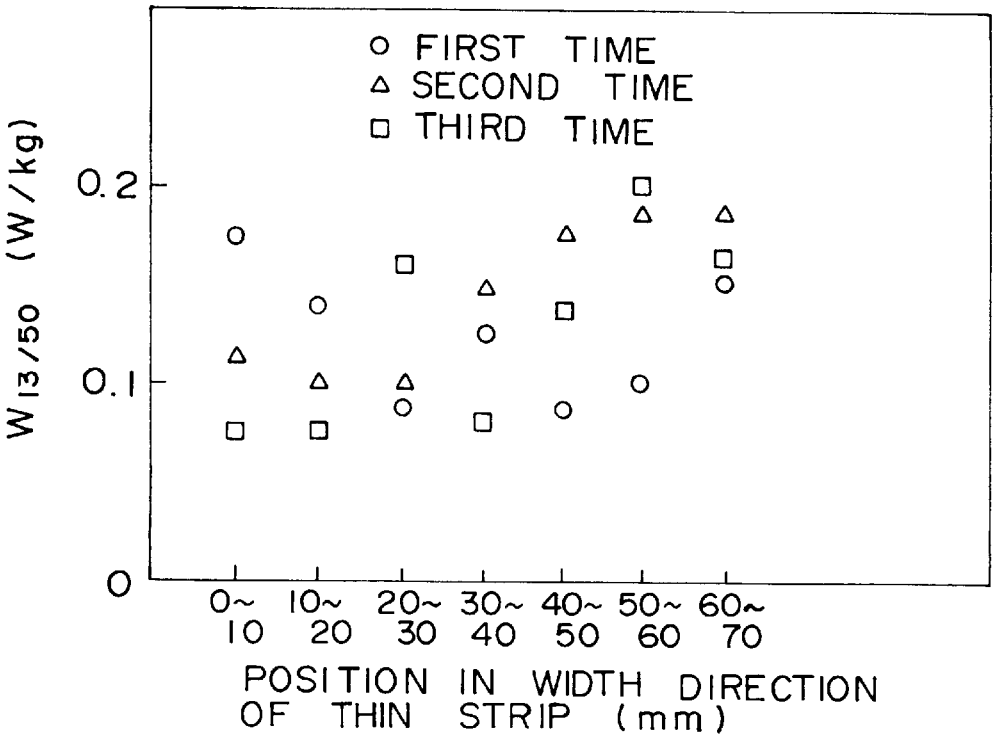
FIG. 2 is a graph showing the distribution of properties in the width direction of a specimen 10 mm wide that has been cut from a thin strip having a cast width of 70 mm.

Further, the distribution of properties in the width direction was evaluated on specimens 10 mm wide which were cut out from thin strips having a cast width of 70 mm. The thin (22–28 mm) strips were cast three times under the same conditions. FIG. 2 of the drawings shows the results of the investigation, from which it was discovered that iron loss values deteriorated at several locations in the width direction. The positions in the width direction where the iron loss properties deteriorated differed depending upon the casting change.

It is thought that the deterioration of the iron loss values shown in FIG. 2 was caused by differences in the amorphous structures occurring at various locations along the width direction. Although the exact relationship between the amorphous structure and iron loss is not established, it is thought that the amorphous structure differences are something like the grain size or grain orientation difference in a crystal structure. Therefore, it became apparent that the cooling speed and the presence of added elements significantly affected the amorphous structure of the strip.

Hence, we have zealously studied the deterioration of wide thin strip by examining changes along the width direction thereof, which deterioration was found to have been caused by differences of amorphous structure.

As a result, it has been discovered that the deterioration of magnetic properties of Fe—B—Si—C amorphous alloy with a large width above about 70 mm was a result of the addition of C. We have found that although the addition of C improves the magnetic properties of the strip when the C is added to a narrow thin strip, it instead deteriorates these properties when C is added to a thin strip whose width exceeded about 50 mm.

To cope with this problem, we have studied the addition of other components capable of suppressing the deterioration of the magnetic properties caused to wide thin strip by the addition of C. As a result, it was found for the first time that the magnetic properties of wide thin strip could be improved by the addition of Mn in a slight amount effective for the improvement of film properties.

On the other hand, we have also examined relevant manufacturing conditions that might be capable of suppressing deterioration of the magnetic properties caused to wide thin strip by the addition of C, even without the addition of other elements. As a result it was found that when the surface roughness of the strip was controlled by casting in an atmosphere containing about 40 vol % or more of a carbonic acid gas, the magnetic properties of the wide thin strip could be improved.

Further, we have discovered that such an improved wide amorphous thin strip can maintain its excellent magnetic properties even when applied to operating transformers.

Experiments relevant to the present invention will be described below.

Amorphous alloy thin strip 70 mm wide and 25 $\mu$m thick was made by rapidly cooling a molten alloy composed of Fe—B—Si and C was added with Mn in various ranges. Cooling occurred at a cooling speed of about $10^{6°}$ C./sec., using the known single roll method. The composition of the alloy was represented by $Fe_{80}B_{11}Si_{9-(d+e)}C_dMn_e$, and the values of d and e were changed from one test to the other.

Figure 3:
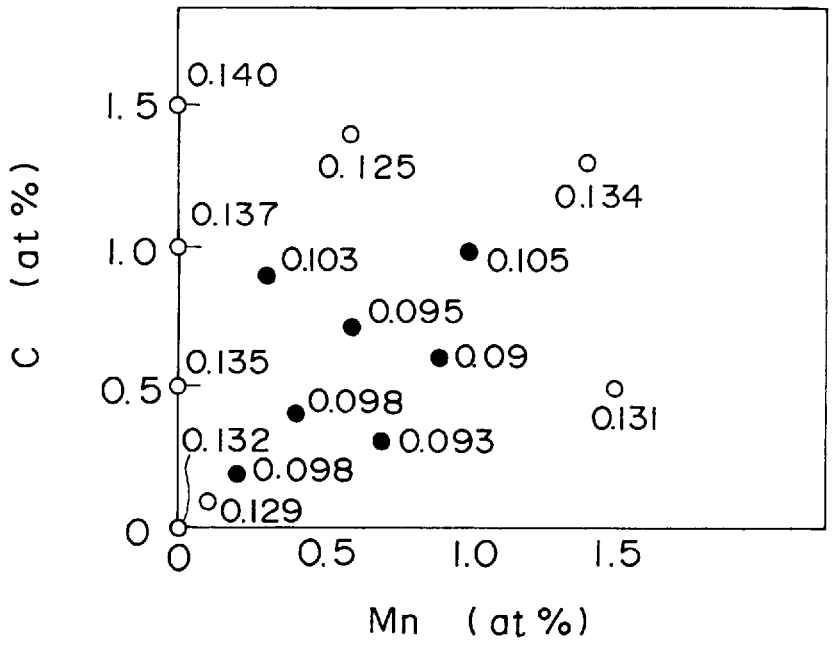
FIG. 3 is a graph showing the effect of C and Mn on the iron loss $W_{13/50}$ of an Fe—B—Si amorphous alloy.
Figure 4:
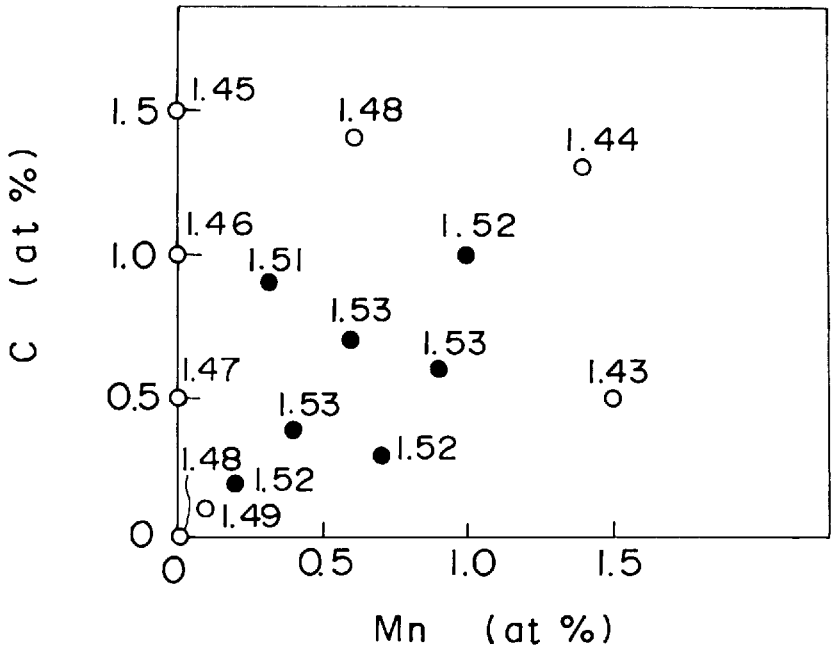
FIG. 4 is a graph showing the effect of C and Mn on the flux density $B_{10}$ of an Fe—B—Si amorphous alloy.

FIG. 3 and FIG. 4 of the drawings show the results of investigation of $W_{13}/_{50}$ (iron loss at 50 Hz, 1.3 T) and $B_{10}$ (flux density in an external magnetic field of 1000 A/m) of the resulting thin strips at 100° C. In FIG. 3, the numerals in the drawing show $W_{13}/_{50}$ (W/kg) values. In addition, the symbol ● shows $W_{13}/_{50} \leqq 0.11$ W/kg and the symbol ○ shows $W_{13}/_{50}>0.11$ W/kg. In FIG. 4, the numerals in the drawings show the $B_{10}$ (T) values. Further, the symbol ● shows $B_{10} \geqq 1.51$ T and the symbol ○ shows $B_{10}<1.51$ T.

As is apparent from the drawings, iron loss and flux density are enhanced in carbon ranges of about $0.2 \leqq C \leqq 1.0$ and manganese ranges of about $0.2 \leqq Mn \leqq 1.0$. It was found that the deterioration of magnetic properties caused by the addition of C was moderated by the addition of Mn. In particular, good results could be obtained in the approximate range of Mn: 0.2–1.0 at %.

Further, there was a tendency that the portions where the properties deteriorated in FIG. 2 have high values of surface roughness as compared with the portions with excellent properties. There is an important relationship between an increase of surface roughness and a decrease of cooling speed. That is, it is contemplated that since a substantial amount of air tends to be caught between the molten alloy and the cooling roll in the strip portions having large values of surface roughness, heat was removed at an insufficient rate from the molten alloy thereby lowering the cooling speed of the thin strip. Therefore, there was thought to be a possibility that lowering the surface roughness values may be effective for preventing deterioration of the desired properties of the strip.

It is known that the surface properties of thin strip are often affected by the atmosphere in which the thin strip was made. For example, "Materials Science and Engineering", A133 (1991), P657 describes that when thin strip is made in a carbonic acid gas atmosphere, its surface properties are improved. Further, the same journal also describes on page 448 that since thin strip made in a carbonic acid gas atmosphere has improved surface properties, the thermal stability of the thin strip is enhanced. However, the literature only refers to narrow thin strip which is composed of an $Fe_{79}B_{14}Si_7$ alloy and further has a width of only 10 mm. The reference examines nothing as to wide thin strip.

We made an amorphous alloy thin strip 70 mm wide and 22–28 μm thick by rapidly cooling a molten alloy composed of Fe—B—Si and provided with various components at a cooling speed of about $10^{6°}$ C./sec, by the single roll method. Further, the concentration of the carbonic acid gas in the casting atmosphere was also changed from run to run. Each thus obtained thin (22–28 mm)strip was annealed in a magnetic field and the iron loss ($W_{13/50}$) and flux density ($B_8$) of each were measured over the entire strip width by a single sheet measuring instrument. The measuring temperature was controlled at 90° C. Further, the surface roughness (Ra) of the strip was also measured at each of five points on the thin strip on the roll surface, at the center and both edges in a sheet width direction according to JIS B0601; the average value of all of them was used as the average value of surface roughness (Ra).

Figure 5:
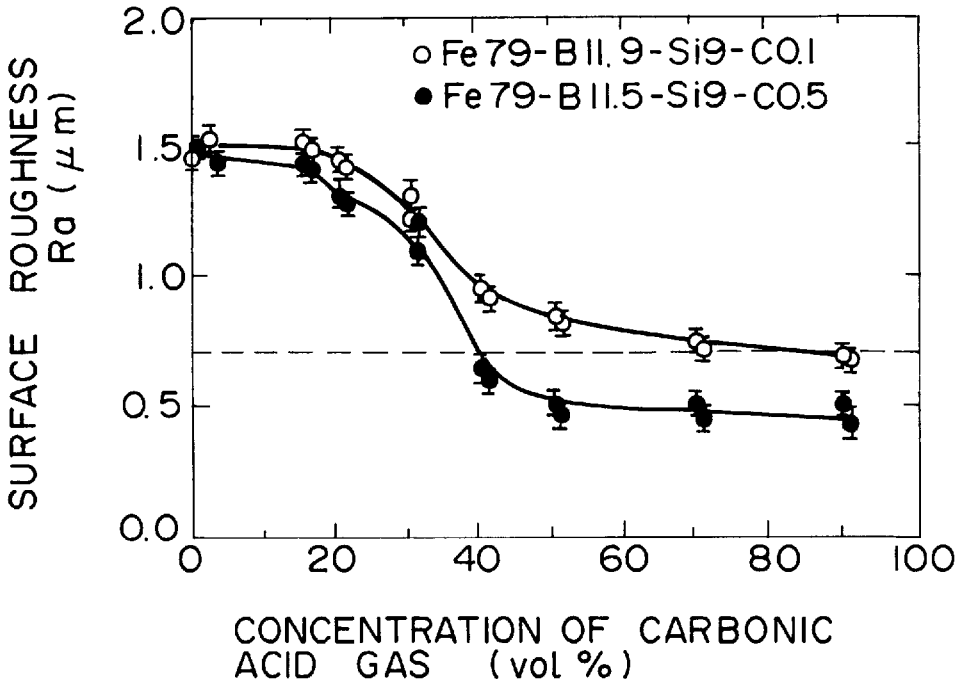
FIG. 5 is a graph showing the effect of the concentration of the carbonic acid gas in a casting atmosphere on the surface roughnesses of thin strips composed of $Fe_{79}B_{11.5}Si_9C_{0.5}$ and $Fe_{79}B_{11.9}Si_9C_{0.1}$.

FIG. 5 shows the effect of the concentration of the carbonic acid gas in the casting atmosphere on the surface roughness of thin strips composed of $Fe_{79}B_{11.5}Si_9C_{0.5}$ and $Fe_{79}B_{11.9}Si_9C_{0.1}$, When thin strip containing a large amount of C is cast in an atmosphere containing about 40% to 90% or more of the concentration of a carbonic acid gas, the surface roughness Ra is controlled at about 0.7 μm or less. Therefore, it is found in this case that the area where the molten alloy $Fe_{79}B_{11.9}Si_9C_{0.1}$ is in contact with the cooling roll is increased and the cooling speed of the thin strip is accelerated.

Figure 6:
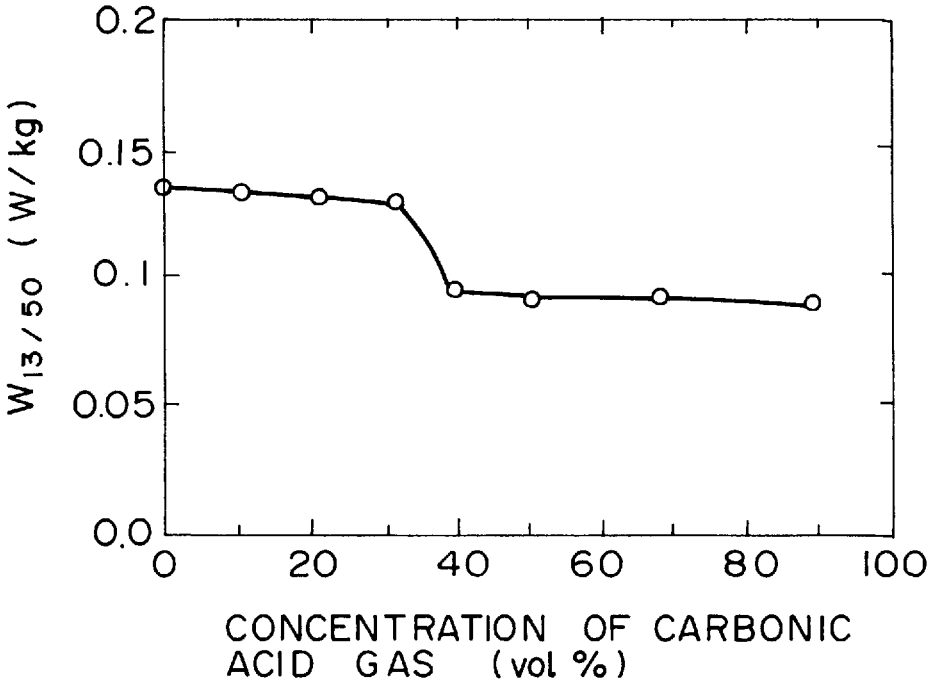
FIG. 6 is a graph showing the effect of the concentration of the carbonic acid gas in a casting atmosphere on iron loss on thin strips having the composition $Fe_{79}B_{11.5}Si_9C_{0.5}$.

FIG. 6 shows the effect on iron loss of the concentration of carbonic acid gas in the casting atmosphere, as to the composition $Fe_{79}B_{11.5}Si_9C_{0.5}$. When this concentration was about 40% or more, the value of Ra was securely controlled to about 0.7 μm or less, and excellent properties were obtained.

Figure 7:
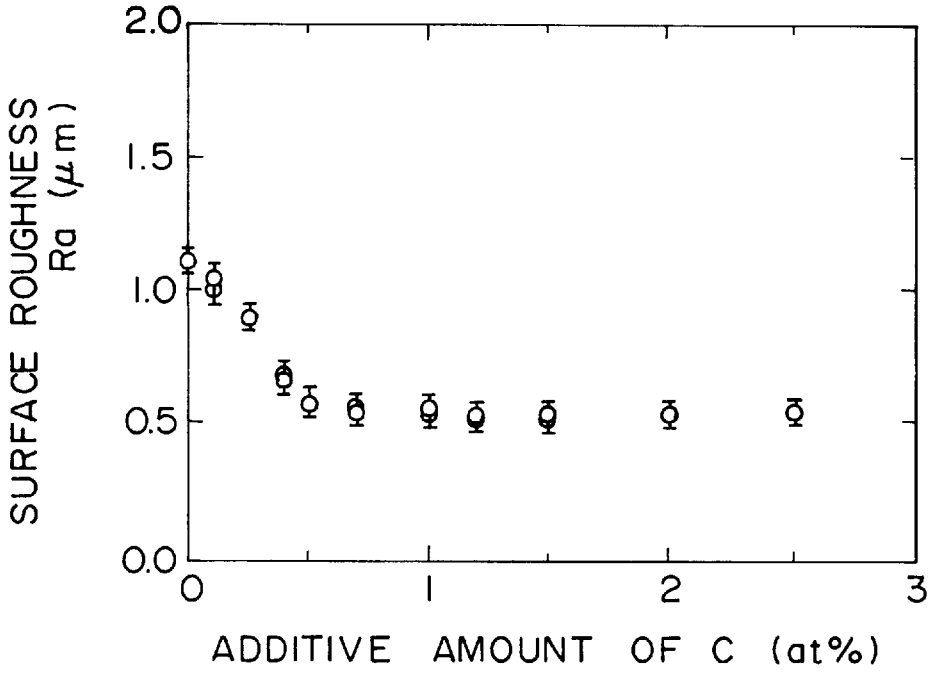
FIG. 7 is a graph showing the effect of C content on the surface roughness of a thin strip having the composition $Fe_{79}B_{10.5}Si_{10.5-x}C_x$.
Figure 8:
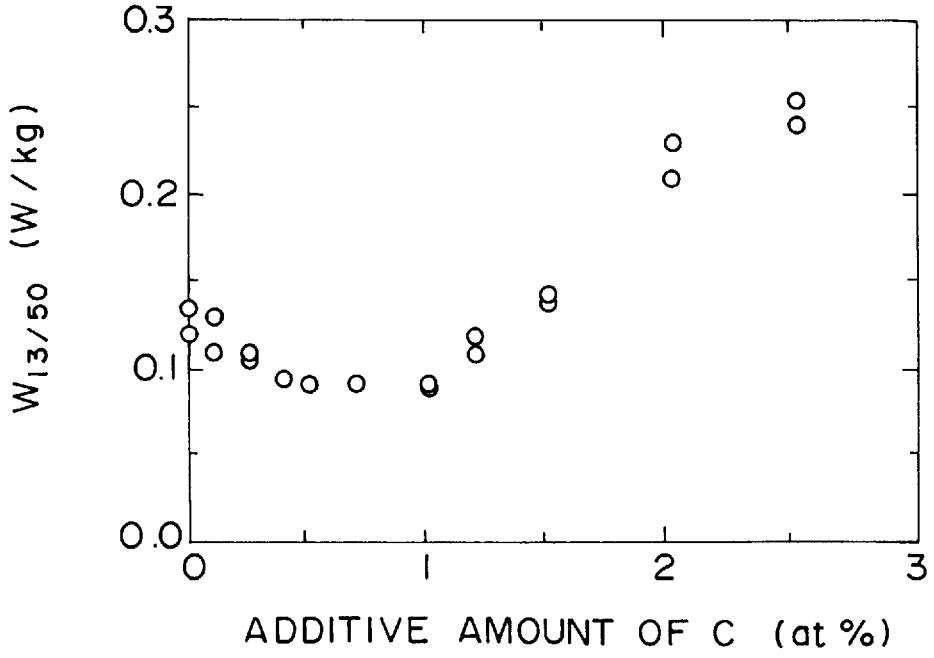
FIG. 8 is a graph showing the effect of C content on iron loss of a thin strip having the composition $Fe_{79}B_{10.5}Si_{10.5-x}C_x$.
Figure 9:
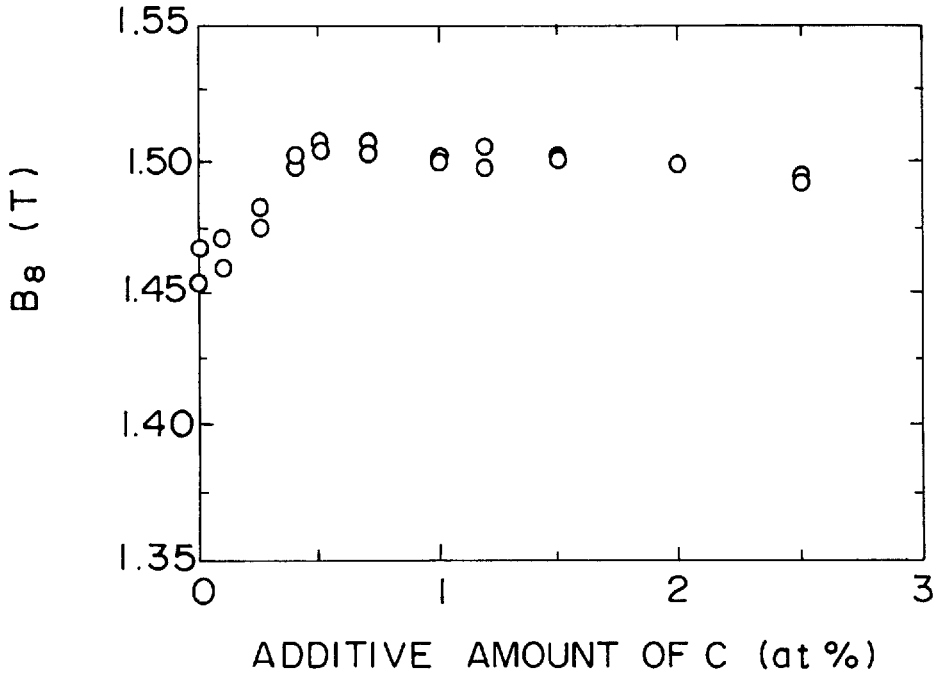
FIG. 9 is a graph showing the effect of C content on flux density of a thin strip having the composition $Fe_{79}B_{10.5}Si_{10.5-x}C_x$.

Further, FIG. 7, FIG. 8 and FIG. 9 show the effects of additive amounts of C on surface roughness (FIG. 7), iron loss (FIG. 8) and flux density (FIG. 9) as to thin strip composed of $Fe_{79}B_{10.5}Si_{10.5-x}C_x$, respectively. It has been found that the preferable range of the added amount of C is about 0.4–1.0%.

As a result, it was found that wide thin strip having a width of about 70 mm or above could be effectively made even in the absence of Mn by rapidly cooling and solidifying molten alloy in an atmosphere containing a carbonic acid gas. Wide thin strip having good properties and excellent surface properties could be obtained when the concentration of the carbonic acid gas was set to about 40 vol % or more and C was present in an amount of about 0.4% atomic or more, preferably about 0.4–1%.

Limitations of the chemical components of the alloy in the present invention are as described below.

Fe:

Fe is an important element affecting the properties of the alloy as a magnetic material. A larger Fe content results in increased flux density. When the Fe content is less than about 78 at %, the flux density is greatly lowered and the alloy cannot be used in transformers, whereas when the Fe content exceeds about 81 at %, increase of iron loss and reduction of crystallizing temperature are made remarkable. Reduction of the crystallizing temperature is not desirable because the crystallization of an amorphous portion is accelerated during the distortion-removing annealing step, and the magnetic properties tend to deteriorate. Thus, the Fe content is limited to about 78–81 at %. A more preferable range is about 79.5–80.5 at %.

B:

B is useful in making the alloy amorphous. When the B content is less than about 9 at %, it is difficult to make the alloy amorphous, whereas when the B content exceeds about 13 at %, the flux density and the crystallizing temperature are lowered. Thus, the B content is limited to the range of about 9–13 at %. A more preferable range is about 10.5–11.5 at %.

Si:

Si favors making the material amorphous, and tends to increase the crystallization temperature. When the Si content is less than about 6 at %, the crystallizing temperature is lowered, whereas when the Si content exceeds about 12 at %, the flux density is lowered. Thus, the Si content is limited to about 6–12 at %. A more preferable range is about 7–11 at % and a still more preferable range is about 7.5–8.5 at %.

C:

C is a useful element for enhancing the magnetic properties of the strip at room temperature. However, as previously mentioned, it also tends to deteriorate the magnetic properties of wide thin strip. To enhance the magnetic properties of the wide thin strip, C must be added in an amount of at least about 0.2 at %, whereas when it exceeds about 1.0 at % the iron loss increases remarkably.

It is important to observe that when the C content exceeds about 1.0 at %, deterioration of magnetic properties at a high temperature cannot be also prevented, even by the addition of Mn as will be described later. Therefore, when Mn is present, the C content is limited to the range of about 0.2–1.0 at %.

When casting is carried out in a carbonic acid gas atmosphere without the addition of Mn, a C content of about 0.4 at % or more can effectively lower surface roughness.

It is contemplated that when thin strip is formed in a carbonic acid gas atmosphere, the surface roughness of the strip is decreased. This is because the rear surface of a puddle made by a molten alloy on a roll is uniformly oxidized and any vibration of the molten metal surface is suppressed. When reaction with the carbonic acid gas is excessive, oxidation is carried out unevenly, and the effect of suppressing puddle vibration becomes insufficient. Since the amount of heat generated by the reaction is excessive, the oxidation caused by the oxygen in the atmosphere is excessive as well. In particular, since the roll temperature is high and since cooling is delayed in the manufacture of the wide thin strip, the surface roughness of a ribbon caused by the puddle vibration is likely to increase. However, when C is present in the molten alloy in an amount of about 0.4 at % or more, no excessive reaction is caused and as a result, it is contemplated that a puddle vibration can be sufficiently suppressed, since dissolution of carbonic acid gas into the molten alloy is limited.

Therefore, when casting is carried out in a carbonic acid gas atmosphere without the addition of Mn, the C content is limited to the range of about 0.4–1.0 at %.

Mn:

Mn is a particularly important element because it eases the effect of cooling speed on the properties of the amorphous strip structure. The deterioration of the magnetic properties in wide thin strip due to the addition of C can be effectively prevented by the addition of Mn without specially controlling the casting atmosphere. To obtain the above effect, Mn must be added in an amount of at least about 0.2 at %. When Mn is present in an amount exceeding about 1.0 at %, the flux density is greatly reduced. Thus, the Mn content is limited to the range of about 0.2–1.0 at %. The Mn content is more preferably in the range of about 0.3–0.5 at % to maintain high flux density.

It is important to observe that when the surface roughness of the strip is adjusted by controlling the casting atmosphere, the addition of Mn is not necessary because the properties of the amorphous structure are controlled by controlling the cooling speed.

Although the proper ranges and the preferable ranges of the components to be added to the alloy are described above, optimum components are represented by the formula $Fe_{80}B_{11}Si_8C_{0.5}Mn_{0.5}$.

Next, a method of manufacturing the alloy of the present invention will be described.

When the alloy is made by the single roll method, the properties of thin strip are mainly determined by the slit nozzle shape, by the spacing between the nozzle and the roll, by the molten alloy injection pressure, by the roll peripheral speed and by the molten alloy temperature. Since the quality of the thin strip is greatly affected by the sheet thickness and the surface roughness, it is preferable that the sheet thickness is controlled to about 25±3 μm and the surface roughness Ra is controlled to about 0.7 μm or less. In particular, when wide thin strip is made, the molten alloy injection pressure is controlled to a relatively low injection pressure of about 0.1–0.3 kgf/cm$^2$ because the molten alloy injection pressure is determined by the surface height of the molten alloy in the tundish to which the slit nozzle is mounted. At the time, it is preferable to set the thickness of the opening of the slit nozzle to about 0.7–1.2 mm and to control the interval between the nozzle and the roll within the range of about 0.05–0.15 mm and the roll peripheral speed within the range of about 18–28 m/sec. to obtain the proper sheet thickness and surface roughness of the thin strip. The nozzle slit being inclined from the normal direction of the roll so that the molten alloy is injected at an inclination of about 100°–130° with respect to the direction toward which the thin strip is moving, the leakage of the molten alloy rearwardly of the nozzle (puddle break) can easily be prevented. Further, it is preferable to control the temperature in the ladle or the tundish so that the temperature of the molten alloy in the slit nozzle is about 50°–150° C. higher than its liquid phase line temperature.

When Mn is not present in the strip, the concentration of carbonic acid gas in the stripmaking atmosphere must be controlled to about 40 vol % or more. When the concentration of the carbonic acid gas is less than 40 vol %, a large number of recesses (pockets) are formed by gas bubbles caught at the surface of the thin strip (roll surface) and the surface roughness is accordingly increased. Since these recesses or pockets reduce the rate of heat transfer from the thin strip to the roll, the cooling speed is decreased. It is preferable to blow the carbonic acid gas between the nozzle and the roll from the rear of the nozzle (from the upstream side in the direction toward which the thin strip is moving).

When Mn is added, the concentration of the carbonic acid gas in the atmosphere need not be particularly limited. This is because of the fact that the effect of cooling speed can be moderated by the addition of Mn.

Thereafter, distortion removing annealing is usually carried out in a magnetic field to enhance the magnetic properties of the strip. The processing temperature at the time is preferably about 300°–450° C. This is because of the fact that, when the processing temperature does not reach about 300° C., introduced distortion cannot be adequately removed. When the processing temperature exceeds about 450° C., crystallization is caused and there is a strong possibility of deterioration of magnetic properties.

EXAMPLES

Example 1

Alloy thin strips 70–300 mm wide and 22–28 μm thick were made from molten alloys composed of the components shown in FIG. 1 by a single roll type liquid rapid cooling method according to the following conditions. Manufacturing conditions:

Melting;

Alloy ingot melted in an induction heating type melting furnace 500 g/heat

Cooling roll;

Made of copper alloy

Internal water cooling type 500 mm dia.×370 mm

Roll peripheral speed: 20–35 m/sec.

Injection nozzle;

Composed of a heat insulating material with a ceramic slit nozzle mounted at the extreme end thereof Slit: 70–300 mm wide×0.8 mm Sheet manufacturing conditions;

Interval between bottom of nozzle slit and roll surface: 0.1 mm

Winding;

Winding by reel

Annealing was carried out in a magnetic field at 350°–400° C. for one hour. The surface roughness of the thus obtained thin strips was measured. Further, after the thin strips were annealed in the magnetic field as a single sheet or a toroidal core, the iron loss and the flux density of the strips were measured. Table 1 also shows the result of measurement of iron loss ($W_{13}/_{50}$) and flux density ($B_{10}$) of the thus obtained thin strips at 100° C.

TABLE 1

| No. | Chemical components (Atomic) | $W_{13/50}$ (w/kg) 100° C. | $B_{10}$ (T) at 100° C. | Reference |
|---|---|---|---|---|
| 1 | $Fe_{78}B_{12}Si_{8.5}C_{0.8}Mn_{0.7}$ | 0.098 | 1.50 | Example |
| 2 | $Fe_{78.5}B_{12}Si_8C_{0.7}Mn_{0.8}$ | 0.099 | 1.51 | Example |
| 3 | $Fe_{78}B_{12}Si_8C_{0.8}Mn_{0.2}$ | 0.100 | 1.52 | Example |
| 4 | $Fe_{70.5}B_{11.5}Si_8C_{0.5}Mn_{0.5}$ | 0.100 | 1.51 | Example |
| 5 | $Fe_{80}B_{12}Si_{7.5}C_{0.3}Mn_{0.2}$ | 0.102 | 1.52 | Example |
| 6 | $Fe_{80.5}B_{11.5}Si_7C_{0.6}Mn_{0.4}$ | 0.105 | 1.52 | Example |
| 7 | $Fe_{81}B_{11.5}Si_{6.5}C_{0.4}Mn_{0.6}$ | 0.106 | 1.53 | Example |
| 8 | $Fe_{81.5}B_{11.5}Si_6C_{0.7}Mn_{0.3}$ | 0.106 | 1.53 | Example |
| 9 | $Fe_{82}B_{11}Si_8C_{0.8}Mn_{0.2}$ | 0.108 | 1.53 | Example |
| 10 | $Fe_{78}B_{13}Si_9$ | 0.130 | 1.48 | Comparative Ex. |
| 11 | $Fe_{80}B_{11}Si_7C_2$ | 0.140 | 1.45 | Comparative Ex. |
| 12 | $Fe_{82}B_{10}Si_7Mn_1$ | 0.142 | 1.46 | Comparative Ex. |
| 13 | $Fe_{83}B_{10}Si_8C_{0.5}Mn_{0.5}$ | 0.154 | 1.43 | Comparative Ex. |
| 14 | $Fe_{80}B_{11}Si_7C_{1.5}Mn_{0.5}$ | 0.125 | 1.48 | Comparative Ex. |
| 15 | $Fe_{80}B_{10}Si_8C_1$ | 0.138 | 1.44 | Comparative Ex. |

As is apparent from Table 1 the amorphous alloy thin strips according to the present invention achieved excellent $W_{13}/_{50}$ and $B_{10}$ values at 100° C. In particular, the thin strips having an Fe content of 80 at % or more were excellent in $B_{10}$.

Example 2

Molten alloys melted to consist of the various chemical components shown in Table 2 were formed into amorphous alloy thin strips by a method similar to Example 1 and annealed in a magnetic field. Table 2 also shows the results of measurements of iron loss ($W_{13}/_{50}$) and flux density ($B_{10}$) at 100° C. of the thus obtained thin strips.

TABLE 2

| No. | Chemical components | $W_{13/50}$ (w/kg) at 100° C. | $B_{10}$ (T) at 100° C. | Reference |
|---|---|---|---|---|
| 1 | $Fe_{80}B_{12}Si_{7.5}C_{0.5}$ | 0.135 | 1.46 | Comparative Example |
| 2 | $Fe_{79.9}B_{12}Si_{7.5}C_{0.5}Mn_{0.1}$ | 0.121 | 1.48 | Comparative Example |

TABLE 2-continued

| No. | Chemical components | $W_{13/50}$ (w/kg) at 100° C. | $B_{10}$ (T) at 100° C. | Reference |
|---|---|---|---|---|
| 3 | $Fe_{79.8}B_{12}Si_{7.5}C_{0.5}Mn_{0.2}$ | 0.105 | 1.50 | Example |
| 4 | $Fe_{79.7}B_{12}Si_{7.5}C_{0.5}Mn_{0.3}$ | 0.090 | 1.55 | Preferable Example |
| 5 | $Fe_{79.6}B_{12}Si_{7.5}C_{0.5}Mn_{0.4}$ | 0.088 | 1.56 | Preferable Example |
| 6 | $Fe_{79.5}B_{12}Si_{7.5}C_{0.5}Mn_{0.5}$ | 0.087 | 1.55 | Preferable Example |
| 7 | $Fe_{79.4}B_{12}Si_{7.5}C_{0.5}Mn_{0.6}$ | 0.096 | 1.53 | Example |
| 8 | $Fe_{79.2}B_{12}Si_{7.5}C_{0.5}Mn_{0.8}$ | 0.102 | 1.51 | Example |
| 9 | $Fe_{79}B_{12}Si_{7.5}C_{0.5}Mn_{1}$ | 0.106 | 1.50 | Example |
| 10 | $Fe_{78.5}B_{12}Si_{7.5}C_{0.5}Mn_{1.5}$ | 0.140 | 1.45 | Comparative Example |

As is apparent from Table 2, the amorphous alloy thin strips according to the present invention achieved excellent $W_{13}/_{50}$ and $B_{10}$ values at 100° C. In particular, thin strips having an Mn content in the range of about 0.3–0.5 exhibited excellent magnetic properties with $W_{13}/_{50}$ values of 0.090 W/kg or less and $B_{10}$ values of 1.55 T or more.

Example 3

Alloy strips 70–300 mm wide and 22–28 μm thick were made from molten alloys composed of the components shown in Table 3 under the same conditions as Example 1.

After the thus obtained thin strips were annealed in a magnetic field as a single sheet or a toroidal core, surface roughness, iron loss and flux density were measured.

The atmosphere was controlled by covering the outlet of a nozzle with a chamber and blowing a carbonic acid gas from the rear of the nozzle. The concentration of the carbonic acid gas was measured at a position nearest to the nozzle.

Annealing temperatures as optimum annealing conditions in the magnetic field were investigated by changing of temperature to about 300°–420° C. and a dc magnetic field of 20 Oe was imposed in the lengthwise direction of the thin strips while keeping each optimum temperature investigated constant for 1.5 hours.

The thin strips were heated to 90° C. (a normal operating temperature of power transformers) and the iron loss ($W_{13}/_{50}$) in 1.3 T excitation and the flux density ($B_8$) in the magnetic field of 800 A/m were measured at 50 Hz by a single sheet magnet measuring device as the magnetic properties of the thin strips.

Table 3 also shows the obtained results.

TABLE 3

| No. | Chemical Components | Width (mm) | Concentration of $CO_2$ (vol %) | Roughness Ra (μm) | $W_{13/50}$ (w/kg) at 90° C. | $B_8$ (T) at 90° C. | Reference |
|---|---|---|---|---|---|---|---|
| 1 | $Fe_{80}B_{12}Si_{7.5}C_{0.5}$ | 70 | 40 | 0.6 | 0.092 | 1.50 | Example |
| 2 | $Fe_{79.9}B_{12}Si_{7.5}C_{0.6}$ | 100 | 40 | 0.6 | 0.089 | 1.52 | Example |
| 3 | $Fe_{79.8}B_{12}Si_{7.5}C_{0.7}$ | 140 | 60 | 0.6 | 0.088 | 1.50 | Example |
| 4 | $Fe_{79.7}B_{12}Si_{7.5}C_{0.8}$ | 100 | 60 | 0.5 | 0.090 | 1.55 | Example |
| 5 | $Fe_{79.6}B_{12}Si_{7.5}C_{0.9}$ | 100 | 50 | 0.6 | 0.088 | 1.56 | Example |
| 6 | $Fe_{79.5}B_{12}Si_{7.5}C_{1}$ | 140 | 50 | 0.6 | 0.087 | 1.55 | Example |
| 7 | $Fe_{80}B_{12}Si_{7.5}C_{0.5}$ | 140 | 60 | 0.5 | 0.096 | 1.53 | Example |
| 8 | $Fe_{80}B_{12}Si_{7.5}C_{0.5}$ | 200 | 60 | 0.5 | 0.093 | 1.51 | Example |
| 9 | $Fe_{80}B_{12}Si_{7.5}C_{0.5}$ | 300 | 50 | 0.5 | 0.091 | 1.50 | Example |
| 10 | $Fe_{80.3}B_{12}Si_{7.5}C_{0.2}$ | 70 | 40 | 0.9 | 0.134 | 1.45 | Comparative Example |

As is apparent from Table 3, when the conditions of the present invention are satisfied, excellent values of iron loss and flux density can be obtained in wide thin strips having a width of 70 mm to as wide as 300 mm or above.

As described above, according to the present invention, the advantageous properties of an amorphous structure can be stabilized in a wide strip having a width of 70 mm or more, and excellent iron loss and flux density values can be obtained when the wide material is composed of Fe—B—Si—C amorphous alloy containing a proper amount of Mn, or is cast in a carbonic acid gas atmosphere as heretofore explained.

Although this invention has been described with reference to numerous specific examples, these are not intended to limit the scope of the claims. Equivalents or equivalent compounds may be substituted for elements and components selected for illustration in the specification and examples, and certain features of the invention may be used independently of other features. Further, rearrangements may be made in the sequence of steps of the stripmaking method, all without departing from the spirit and scope of the invention as defined in the appended claims.

What is claimed is:

1. An iron-based cast amorphous alloy thin and wide strip having a cast width of about 70 mm or above, and a thickness of about 22–28 μm, consisting essentially of an amorphous alloy of the components $Fe_aB_bSi_cC_d$, in approximate atomic percentages of components a, b, c and d in the following ranges:

$78 \leqq a \leqq 81$ at %

$9 \leqq b \leqq 13$ at %

$6 \leqq c \leqq 12$ at %

$0.4 \leqq d \leqq 1.0$ at %;

wherein said thin strip is made by casting said alloy on a casting roll in an atmosphere containing carbonic acid gas in an amount of about 40 vol % or more followed by cooling and solidifying said cast alloy, and wherein said strip as formed in said casting process has an average surface roughness Ra of about 0.7 $\mu$m or less, when measured on the cast strip surface that is in contact with said casting roll.

2. The alloy strip defined in claim 1 wherein a is about 79.5–80.5% atomic.

3. The alloy strip defined in claim 1 wherein b is about 10.5–11.5% atomic.

4. The alloy strip defined in claim 1 wherein c is about 7–11% atomic.

5. The alloy strip defined in claim 1 wherein c is about 7.5–8.5% atomic.

6. The alloy strip defined in claim 1 wherein d is about 0.4–1.0% atomic.

7. The alloy strip defined in claim 1 wherein said components are $Fe_aB_bCi_cC_dMn_e$and wherein e is about 0.3–0.5% atomic.

8. The alloy strip defined in claim 1 wherein the sheet thickness is about 25±3 $\mu$m.

9. The alloy strip defined in claim 1 wherein the strip width is about 50 to 300 mm.

10. The alloy strip defined in claim 1 wherein the components of the strip have the atomic formula $Fe_{80}B_{11}Si_8C_{0.5}Mn_{0.5}$.

* * * * *